United States Patent [19]

Klein

[11] Patent Number: 4,741,445

[45] **Date of Patent: * May 3, 1988**

[54] KNOCKDOWN STORAGE RACK WITH WEDGE CONNECTORS

[75] Inventor: Herbert H. Klein, Arlington Heights, Ill.

[73] Assignee: Unarco Industries, Inc., Chicago, Ill.

[ * ] Notice: The portion of the term of this patent subsequent to Dec. 15, 2004 has been disclaimed.

[21] Appl. No.: 3,503

[22] Filed: Jan. 15, 1987

[51] Int. Cl.[4] ..... A47B 47/00

[52] U.S. Cl. ..... 211/192; 211/182

[58] Field of Search ..... 211/183, 182, 192; 248/222.2, 231.9, 301; 403/233, 235, 237, 254

[56] References Cited

U.S. PATENT DOCUMENTS 4,421,239 12/1983 Vargo ..... 211/192 X

*Primary Examiner*—Robert W. Gibson, Jr.
*Assistant Examiner*—Blair Johnson
*Attorney, Agent, or Firm*—Clement and Ryan

[57] ABSTRACT

A wedge connector for securing the horizontal cross beam of a storage rack to the hollow upright posts of the system. Two ear-supporting members extend laterally from an elongated shank, each of which members carries an upwardly extending wedging ear. The wedge connector has a shape and carefully controlled dimensions that make it possible to insert the elongated shank and lower wedging ear into the upper slot of a pair of elongated slots in the upright post of the storage rack. The elongated shank is then swung down within the interior of the hollow post into a position where the lower wedging ear can be moved back out of the lower elongated slot of the pair of slots, so that the wedge connector can then drop directly down into its operative position. In this position portions of the wall of the upright post are embraced by a downwardly opening rectangular notch at the bottom edge of each laterally extending ear-supporting member. The dimensions of the upper wedging ear of the wedge connector are controlled so that the upper ear cannot be inserted in the upper elongated slot in the upright post. The features described produce the advantage of being able to insert the wedge connector from outside a hollow, completely enclosed tubular upright post, while at the same time retaining the advantage of locating the elongated shank on the inside of the post when the connector has been placed in its final operative position.

12 Claims, 1 Drawing Sheet

KNOCKDOWN STORAGE RACK WITH WEDGE CONNECTORS

FIELD OF THE INVENTION

This invention relates to a wedge connector with a knockdown storage racks, and more particularly a wedge connector to secure the horizontal cross beams of the rack to the combination of the hollow upright posts of the system.

BACKGROUND OF THE INVENTION

Knockdown racks having slotted hollow upright posts to which horizontal cross beams are secured by wedge connectors have been widely used for storage shelving and pallet racks. Structures of this type are shown in U.S. Pat. Nos. 2,760,650 to Franks, 2,815,130 to Franks, 3,490,604 to Klein, 3,637,086 to Klein, and 4,421,239 to Vargo.

The wedge connector of the first three and the fifth of these patents is inserted from inside the hollow upright post to secure the horizontal cross beams to the posts, and the wedge connector of the fourth patent is inserted from outside the post. Each of the wedge connectors referred to is formed of a flat, elongated shank with two wedging ears extending laterally from the shank. In the case of the first three and fifth patents, the elongated shank is located within the inside of the hollow upright post when the knockdown rack is assembled, and in the case of the fourth patent the elongated shank is located outside the hollow post when the rack is assembled.

The advantage of positioning the elongated shank portion of the wedge connector within the inside of the upright post, as in the first three and fifth patents referred to, is that the force exerted by the inner edge of the shank against the inside wall of the upright post can be distributed over a relatively large area. However, it is not possible with these wedge connectors to use a completely closed hollow post, since as explained above the connector must be inserted from inside the post.

The advantage to the connector disclosed and claimed in the fourth patent under discussion is that it can be used with a completely enclosed hollow post. However, the portions of the wedge connector that press against the wall of the hollow post abut that wall over a smaller area than with the other four connectors, and it does not have a single, continuous shank portion (supplemented by a second, smaller portion) in contact with the post as is the case in the other four patents, but instead has three distinct smaller abutment portions making that contact.

The wedge connector of the present invention unexpectedly makes it possible to achieve both the advantages just referred to, without either of the accompanying disadvantages. First, with this wedge connector a large central portion of the elongated shank member, supplemented by a smaller lower portion of the shank, is positioned against the inside wall of the hollow upright post. Second, because of the unique configuration of this wedge connector, it is possible to insert it, quickly and easily, from outside a completely enclosed hollow post.

SUMMARY OF THE INVENTION

The wedge connector of the present invention is used with a knockdown storage rack that includes a hollow upright post having at least one pair of vertically aligned, vertically oriented, spaced elongated slots in the wall of the post. The upper one of the slots of the pair has a first predetermined length, the lower one of the slots has a second predetermined length, and the two slots of the pair are spaced apart vertically a third predetermined distance.

In a typical storage rack, the elongated slots described comprise a series of slots, in two adjacent corners of a hollow post, extending substantially throughout the entire height of the post. In a widely used rack of this type, the elongated slots are substantially identical and are equally spaced, with the first, second and third dimensions just referred to all being equal. The post may be wholly enclosed or it may have a C-shaped or U-shaped cross section, as desired.

The storage rack further includes a horizontal cross beam that terminates in a support plate (typically in the form of a corner angle) that is matingly related to the exterior surface of the hollow upright post. This cross beam support plate defines a vertically oriented elongated slot of substantially the same shape and dimensions as the upper elongated post slot in the above described pair of post slots. The bottom edge of this vertical elongated slot in the cross beam support plate is spaced above the bottom edge of the support plate a distance equal to the third predetermined distance mentioned above.

The wedge connector of this invention includes a flat, elongated shank of a length to span at least the lower elongated post slot of the pair of slots, the portion of the post wall lying between the two slots, and a portion of the upper post slot. In addition, the shank preferably extends a distance below the lower post slot.

The median plane of the shank is perpendicular to the planes tangent to the respective surfaces of the upright post wall and the mating cross beam support plate, in the area adjacent the elongated slots in the post and support plate, when the wedge connector is installed in its operative position. Preferably at least the inner edge of the shank, which abuts the inner surface of the post wall when the wedge connector is in its operative position, is straight.

Two ear-supporting members extend laterally from the inner edge of the elongated shank, and a wedging ear is supported by each of these laterally extending members. These ear-supporting members are disposed one above the other when the wedge connector is installed in its operative position in the rack.

The shape and dimensions of the lower wedging ear are such that the lower end portion of the wedge connector, with the wedging ears pointed downward and the longitudinal axis of the elongated shank generally perpendicular to the upper elongated post slot, can be inserted from outside the post into that upper slot. The shape, dimensions and relationship to the elongated shank of the upper wedging ear are such that the upper end portion of the wedge connector can not pass through the upper post slot at the time the lower end portion of the connector is inserted in the post, and preferably can not do so either after the connector is pivoted downward as will be described below.

The lower end portion of the elongated shank is pivotable within the upper elongated post slot down about the upper portion of the shank, after the shank has been inserted in the upper slot, to bring the lowest point on the bottom edge of the lower wedging ear to a position just within the lower elongated post slot.

Two other limitations make it possible to pass the lower wedging ear out through the lower post slot after the wedge connector has been inserted in the upper post slot and pivoted downward about its upper end portion to present the lower ear to the lower post slot. First, the shape, dimensions and location on the elongated shank of the lower ear are such that the lowest point on the bottom edge of the lower ear must fall above the bottom edge of the lower post slot when the wedge connector pivots downward about its upper end portion to bring the lower ear to the lower post slot. Second, the shape and dimensions of the lower ear are such that it can pass through the lower post slot when the wedge connector pivots as described about its upper end portion.

In the embodiment of this invention illustrated herein, the inner and outer edges of the flat, elongated shank of the wedge connector are both straight and are parallel to each other, and the structural limitations specified above are met by the following dimensional limitations:

1. The distance between (a) the bottom edge of the upper laterally extending ear-supporting member and (b) the bottom edge of the lower ear-supporting member is preferably substantially equal to the above mentioned second predetermined length plus the third predetermined distance, or in other words the distance between the bottom edges of the two post slots into which these ear-supporting members are inserted when the wedge connector is in place in the rack.

2. The maximum distance, measured perpendicularly to the inner edge of the shank, from the outer side edge of the wedging ear carried by the lower supporting member, across that ear and its associated laterally extending support member, and then across the shank to the outer edge of the shank, is less (preferably slightly less) than the length of the upper elongated slot in the hollow upright post (the first predetermined length referred to above).

3. The maximum distance measured similarly for the wedging ear carried by the upper laterally extending support member is greater (preferably only slightly greater) than the length of the upper elongated slot in the upright post (the first predetermined length mentioned above).

4. The maximum distance between the upper and bottom edges of the lower ear is less (preferably slightly less) than the length of the lower elongated slot in the post (the second predetermined length).

5. The distance between (a) the lowest point on the bottom edge of the lower wedging ear and (b) the highest point on the upper edge of the elongated shank member is less (preferably slightly less) than the above mentioned first predetermined length, plus the second predetermined length, plus the third predetermined distance that represents the spacing between the pair of slots in the post.

In addition to the structural limitations described above, the inner edge of each of the wedging ears is inclined away from the connector shank in the upward direction towards the free end of the ear, with the bottom portion of that inner edge being spaced from the inner edge of the shank a distance less than the combined thickness of the cross beam support plate and the wall of the post. This provides a wedging surface to confine both (a) the portion of the cross beam support plate that lies immediately above the elongated slot in the plate, and (b) the portion of the support plate that lies immediately above the bottom edge of the plate, when the support plate slot is aligned with the upper post slot, the lower wedging ear is inserted through the support plate slot and the upper post slot, the lower ear is swung downward in a circular path until it passes through the lower post slot, and the support plate is moved downward.

The construction described above means that when the support plate is brought into position to be secured to the upright hollow post, portions of the support plate above the confined portions just mentioned will be urged against the outer surface of the wall of the upright post, and the inner edge of the elongated shank will be urged against the inner surface of the post wall, to connect the support plate and its associated cross beam securely to the upright post.

Various other features to be explained below are included in specific embodiments of this wedge connector.

A more detailed explanation of the invention is provided in the following description and claims, and is illustrated in the accompanying drawing.

DETAILED DESCRIPTION OF ILLUSTRATIVE EMBODIMENT

General Construction Of Rack

Figure 1:
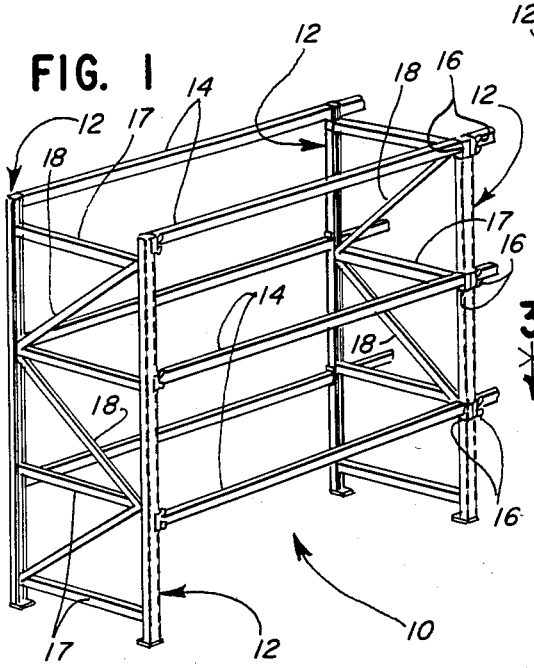
FIG. 1 is a perspective view of a portion of a storage rack unit that includes the wedge connector of this invention.

FIG. 1 is a perspective view of a portion of a storage rack 10 having four hollow upright posts 12 to which horizontal cross beams 14 are secured by wedge connectors 16 formed according to this invention. Short horizontal braces 17 and diagonal braces 18—all welded together and to upright posts 12 as shown—complete this portion of one embodiment of a rack with which the wedge connector of this invention can be used.

Figure 2:
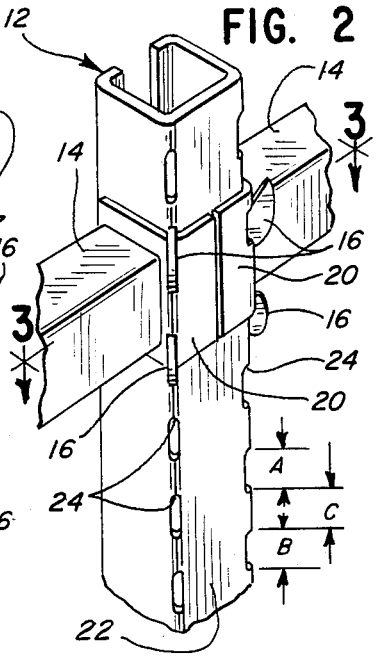
FIG. 2 is an enlarged, fragmentary perspective view of the lower right-hand portion of the storage rack shown in FIG. 1.

In FIG. 2, which is an enlarged, fragmentary perspective view of the lower right-hand portion of the storage rack 10 shown in FIG. 1, support plates 20 at the ends of cross beams 14 are connected to upright post 12 through wedge connectors 16. Each cross beam 14 terminates in a support plate 20 that is matingly related to the exterior surface 22 of post 12. Support plate 20, as is the case in the storage rack illustrated in FIGS. 1 and 2, is typically in the form of a corner angle.

To receive wedge connectors 16, hollow upright post 12 has at the two near corners a vertically aligned series of vertically oriented slots that in this embodiment are substantially identical, equally spaced slots 24. The wedge connector of this invention is designed to be used with any pair of immediately adjacent slots 24.

The upper slot of any given pair of elongated slots 24 with which wedge connector 16 may be used has a first predetermined length A. The lower slot of the pair has a second predetermined length B. The third predetermined distance between the two slots of the pair is designated in the drawing as distance C. In the rack illustrated, predetermined lengths A and B and predetermined distance C, as is typically the case, are equal.

Figure 4:
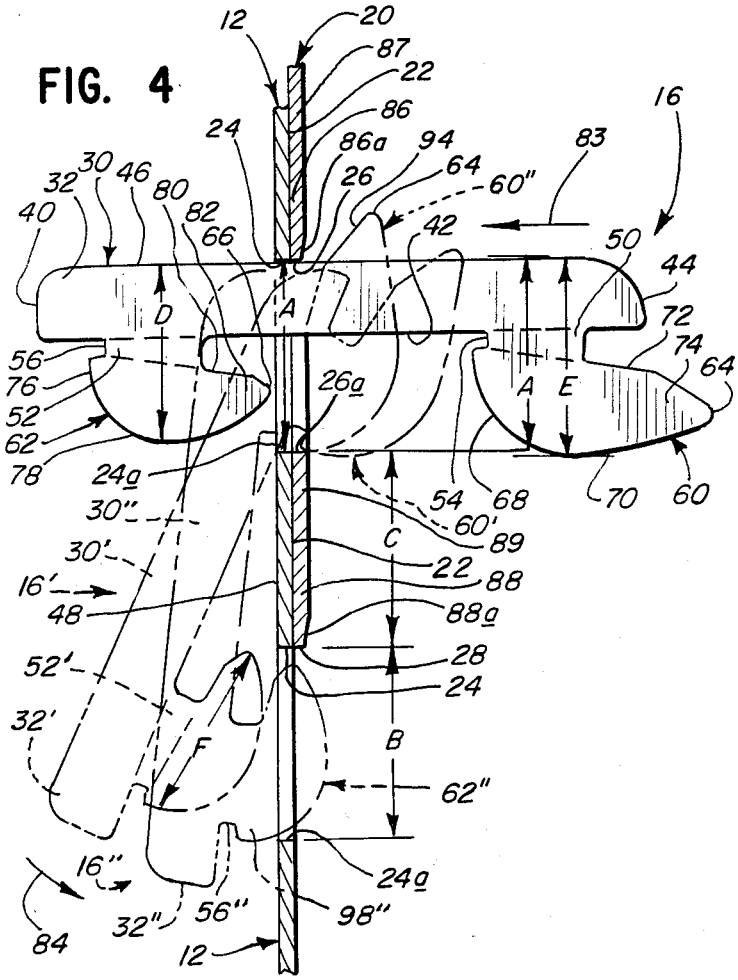
FIG. 4, taken along line 4—4 in FIG. 3, is a further enlarged, sectional view of a portion of the wall of an upright post and a portion of the support plate of a cross beam matingly engaged with the post, said Figure showing in phantom successive positions taken by the wedge connector of this invention after it is initially inserted (as shown in full lines) within the interior of a hollow upright post from outside the post, and then pivoted down within the interior of the post.
Figure 5:
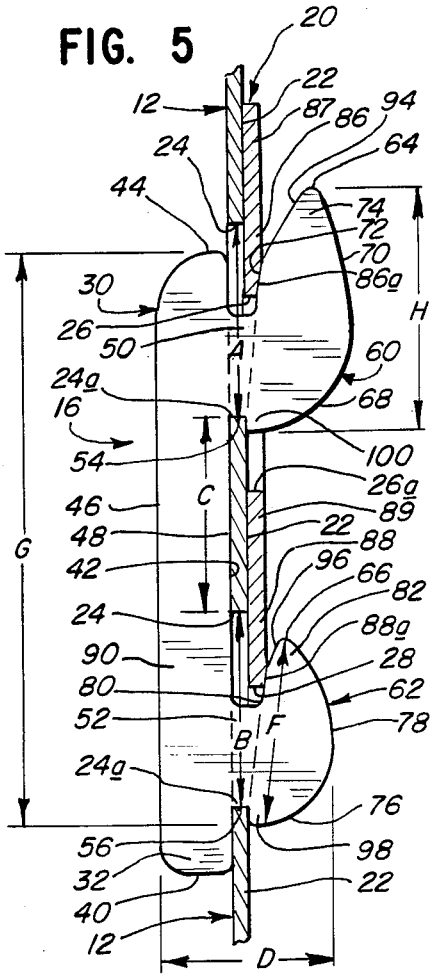
FIG. 5 is a cross-sectional view similar to FIG. 4 showing the wedge connector in its operative position and the cross beam support plate after it has been moved down into engagement with the wedging ears of the wedge connector.

As best seen in FIGS. 4 and 5, each cross beam support plate 20 defines a vertically oriented elongated slot 26 to match upper slot 24 in a given pair of slots in post 12. Bottom edge 26*a* of vertical elongated slot 26 is spaced above bottom edge 28 of cross beam support plate 20 a distance equal to third predetermined distance C.

General Configuration Of Wedge Connector

The general configuration of the wedge connector of this invention will now be described by reference to FIGS. 3 and 4.

Flat, Elongated Shank

Flat, elongated shank 30 is sufficiently long to span lower elongated slot 24 in post 12, the portion of the post wall lying between the upper and lower slots, and a portion of upper slot 24, and in the embodiment shown to extend (at portion 32) below the lower one of slots 24.

Figure 3:
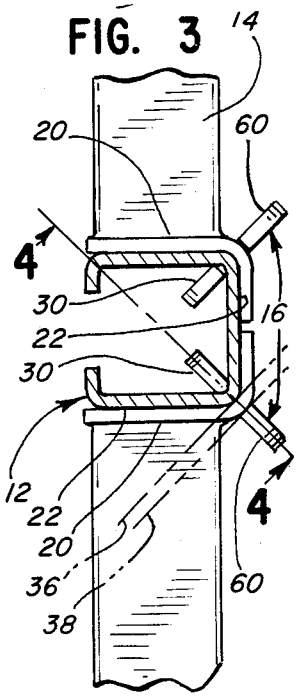
FIG. 3 a fragmentary sectional view, taken along line 3—3 in FIG. 2, of the wedge connector of this invention installed in place in the assembled rack.

As seen in FIG. 3, median plane 34—34 of elongated shank 30 of wedge connector 16 is perpendicular to planes 36—36 and 38—38, which are tangent to exterior surface 22 of the wall of hollow upright post 12 and the exterior wall of mating support plate 20 of cross beam 14, respectively, in the area adjacent post slots 24 and support plate slot 26, when wedge connector 16 is installed in its operative position.

Elongated shank 30 has a bottom edge 40, an inner edge 42, an upper edge 44, and an outer edge 46. Preferably at least inner edge 42, which abuts inner surface 48 of the wall of upright post wall 12 when wedge connector 16 is in its operative position, is straight. Outer edge 46 of shank 30 is remote from post 12 when the wedge connector is in its operative position. In the embodiment shown and described herein, outer edge 46 is also straight, and is parallel to inner edge 42 of the shank.

Ear-Supporting Laterally Extending Members

Ear-supporting member 50 extends laterally from the upper portion of straight inner edge 42 of elongated shank 30, and ear-supporting member 52 extends laterally from the lower portion of inner edge 42. Each of these members 50 and 52 is associated with one of a pair of vertical elongated slots 24 of upright post 12. Ear-supporting members 50 and 52 are disposed one above the other when the wedge connector is installed in its operative position in the storage rack.

The distance between bottom edge 54 of upper ear-supporting member 50 and bottom edge 56 of lower ear-supporting member 52 is preferably substantially equal to the distance between bottom edges 24*a* of post slots 24 with which members 50 and 52 are associated, or in other words second predetermined length B plus third predetermined distance C.

Wedging Ears

Wedging ear 60 is supported by upper laterally extending member 50, and wedging ear 62 is supported by lower laterally extending member 52. Free end 64 of wedging ear 60 and free end 66 of wedging ear 62 are directed upward when wedge connector 16 is installed in its operative position in the storage rack.

Ear 60 has a bottom edge 68, an outer side edge 70, upper edge 64, and inner edge 72, the latter being adjacent upper portion 74 of ear 60. Lower ear 62 has similar edges 76, 78, 66 and 80, the latter being located adjacent upper portion 82 of ear 62.

Insertion Of Wedge Connector

The manner of insertion of wedge connector 16 in vertical elongated slots 24 of the wall of upright post 12 can be seen from the respective outlines of wedge connector 16, and of connectors 16' and 16'' drawn in phantom, in FIG. 4.

As there seen, the shape and dimensions of lower ear 62 are such that the lower end portion of wedge connector 16 can be inserted from outside post 12 into upper elongated slot 24 of upright post 12, with wedging ears 60 and 62 pointed downward and the longitudinal axis of elongated shank 30 generally perpendicular to lower slot 24. Maximum distance D, measured perpendicularly to inner edge 42 of elongated shank 30, from outer side edge 78 of lower wedging ear 62, across ear 62 and its associated ear-supporting member 52, and then across shank 30 to outer edge 46 of shank 30, is less than first predetermined length A of lower slot 24. (Maximum distance D is preferably only slightly less than the indicated value, in order to keep wedging ear 60 as strong as possible.) This dimension permits the lower portion of shank 30 to be inserted in upper elongated post slot 24 in the manner described along direction 83, from right to left in FIG. 4.

At the same time, the shape and dimensions of upper wedging ear 60 are such that the upper end portion of wedge connector 16 can not pass through upper post slot 24 when the lower end portion of the connector is being inserted in that slot as just described. Maximum distance E, measured perpendicularly to inner edge 42 of elongated shank 30, from outer side edge 70, across wedging ear 60 and its associated laterally extending support member 50, and then across shank 30 to outer edge 46 of the shank, is greater than first predetermined length A of upper slot 24. (Maximum distance E is preferably only slightly greater than the indicated value, in order to limit the amount of material necessary for the manufacture of wedge connector 16 while at the same time keeping wedging ear 60 of strong construction.) This prevents ear 60 and the upper portion of wedge connector 16 from passing through upper slot 24.

The shape and dimensions of the upper portion of elongated shank 30' and the shape, dimensions and location on the shank of wedging ears 60' and 62' are such that after the upper ear has been inserted in upper elongated post slot 24 while cross beam support plate 20 is matingly engaged with the wall of post 12, and upper post slot 24 and support plate slot 26 are aligned with each other (as in FIG. 4), the lower end portion of shank 30' is pivotable within upper post slot 24 down around the upper end portion of the shank, along a curved path in counterclockwise direction 84 to the position shown in the lower part of FIG. 4, from which position lower ear 62'' can be moved forward and inserted through lower slot 24 from inside upright post 12.

Two dimensions (which are best seen in FIG. 5) are important in making this pivoting and insertion possible. First, distance F between the highest point on upper edge 66 and the lowest point on bottom edge 76 of wedging ear 62 is less than second predetermined length B. (Distance F is preferably only slightly less than the indicated value, in order to extend upper portion 82 of wedging ear 62 as high as possible and still stay within the prescribed maximum limit.) Second, maximum distance G between the highest point on upper edge 44 of elongated shank 30 and the lowest point on bottom edge 76 of lower wedging ear 62 must be less than first predetermined length A, plus second predetermined length B, plus third predetermined distance C.

Upper edge 44 of elongated shank 30 is rounded so as to facilitate swinging of the shank, after it has been inserted in elongated slot 26 in cross beam support plate 20 and upper elongated post slot 24 in the wall of post 12 that is aligned therewith, down around to a position where lower ear 62 can pass, as just described, through lower elongated slot 24.

Wedging Action Of Ears

Inner edges 72 and 80 of wedging ears 60 and 62, respectively, are inclined away from shank 30 in the upward direction towards the respective free end of each ear. The bottom portion of each of inner edges 72 and 80 is spaced from inner edge 42 of shank 30 a distance less than the combined thickness of cross beam support plate 20 and the wall of upright post 12.

With this configuration, inner edge 72 of upper ear 60 provides a wedging surface to confine portion 86 of cross beam support plate 20 that lies immediately above elongated slot 26 in that plate. Similarly, inner edge 80 of lower ear 62 provides a wedging surface to confine portion 88 of support plate 20, which lies immediately above bottom edge 28 of the plate. Support plate portions 86 and 88 are slightly beveled at **86*a* and 88*a***, respectively, to receive the inner edges of the corresponding wedging ears.

From this description and the showing in FIG. 5, it will be seen that when cross beam support plate 20 is moved down from the position shown in FIG. 4 to the position shown in FIG. 5, with wedge connector 16 in its operative position, support plate portions 87 and 89, which lie above support plate portions 86 and 88, respectively, will be urged against the exterior surface 22 of the wall of upright post 12. At the same time, inner straight edge 42 of shank 30 will be urged, at both midportion 90 and lower portion 32 of the shank, against inner surface 48 of the wall of upright post 12. As a consequence, support plate 20 and its associated cross beam 14 will be connected securely to post 12.

Secure Positioning Of Wedge Connector

The secure positioning of wedge connector 16 when installed in its operative position to connect cross beam 14 with upright post 12 is best seen in FIG. 5. As there illustrated, both bottom portion 32 of elongated shank 30 and bottom portion 98 of lower wedging ear 62 extend below bottom edge 56 of lower ear-supporting member 52, to form a downwardly opening notch having a rectangular cross section. When the wedge connector passes through successive positions 16' and 16'' shown in phantom in FIG. 4, the rectangular notch just described will continue forward until elongated shank 30 is vertically oriented. At this time, the notch will be directly above bottom edge **24*a* of lower elongated post slot 24**.

At this juncture in the installation of wedge connector 16, the connector drops directly down into its operative position as shown in FIG. 5. In this position, as will be seen, the downwardly opening notch just described embraces the portion of the post wall that lies directly below lower post slot 24, so that portion 98 of lower wedging ear 62 abuts exterior surface 22 of the wall of upright post 12, and inner edge 42 of lower portion 32 of elongated shank 30 abuts interior surface 48 of the post wall.

A similar downwardly opening notch of rectangular cross section is formed at the bottom of upper wedging ear 60, by inner edge 42 of elongated shank 30, bottom edge 54 of upper ear-supporting member 50, and bottom portion 100 of upper wedging ear 60 (which extends below edge 54). Here, again, the downwardly opening rectangular notch embraces the portion of the post wall that lies directly beneath upper post slot 24, so that portion 100 of upper wedging ear 60 abuts exterior surface 22 of the post wall, and inner wall 42 of elongated shank 30 abuts interior surface 48 of the post wall.

To reduce the risk that upper wedging ear 60 may somehow slip through upper post slot 24 into the interior of hollow post 12, distance H (shown in FIG. 5) between the highest point on upper edge 64 of upper ear 60 and the lowest point on bottom edge 68 of ear 60, measured parallel to inner edge 42 of elongated shank 30, is larger than first predetermined length A of upper elongated post slot 24. For increased security, distance H is preferably very substantially greater than length A.

The above detailed description has been given for ease of understanding only. No unnecessary limitations are to be understood therefrom, since modifications will be obvious to those skilled in the art.

I claim:

1. A wedge connector in combination with a knockdown storage rack that includes a hollow, upright, post having an inside, an outside and at least one pair of vertically aligned, vertically oriented, spaced elongated slots in the wall of said post, the upper slot of said pair having a first predetermined length, the lower slot having a second predetermined length, the two slots of said pair being spaced apart vertically a third predetermined distance, said rack further including a horizontal cross beam that terminates in a support plate matingly related to the exterior surface of said post, said support plate defining a vertically oriented elongated slot of substantially the same shape and dimensions as said upper elongated slot in said post wall, the bottom edge of said vertical elongated slot in said cross beam support plate being spaced above the bottom edge of the support plate a distance equal to said third predetermined distance, which wedge connector comprises:

(a) a flat, elongated shank spanning at least the lower one of said two post slots, the portion of the post wall lying between said two slots, and a portion of said upper slot, the median plane of said shank being perpendicular to the respective planes tangent to the surfaces of the wall of said hollow post and of said mating support plate in the area adjacent said elongated slots in said post and said support plate, said elongated shank having a width bottom edge, an inner edge, an upper edge and an outer edge, the inner edge of said shank abutting the inner surface of said post wall, and the outer, edge of said shank being remote from said post wall, (b) two ear-supporting members extending laterally from said inner edge of said elongated shank, one for each slot of said pair of post slots, said ear-supporting members being disposed one above the other;

(c) a wedging ear supported by each of said laterally extending members, said two ears being disposed one above the other, with a free end of each of said ears being directed each of said ears having a bottom edge, an outer side edge, an upper edge located at the free end of the ear, and an inner edge adjacent the upper portion of said ear, the lateral dimension of said connector adjacent the lower end thereof, comprising the widths of said shank, said lower ear-supporting member and said lower ear, being slightly less than said first predetermined length of said upper post slot such that said lower end of said wedge connector, with said wedging ears pointed downward and the longitudinal axis of said elongated shank generally perpendicular to the upper one of said two elongated post slots, is inserted from outside the post into said upper post slot, the lateral dimension of said connector adjacent the upper end thereof, comprising the widths of said shank, said upper ear-supporting member and said upper ear, being slightly more than said first predetermined length of said upper post slot such that said upper end of said wedge connector can not pass through said upper elcngated post slot during insertion of said lower end portion of said wedge connector into said upper post slot, the shape and dimensions of the upper portion of said elongated shank and the shape, dimensions, and location on said shank of said two wedging ears being such that, after said lower wedging ear has been inserted in said upper elongated post slot while said cross beam support plate is matingly engaged with said post wall and said upper post slot and said support plate slot are aligned with each other, the lower end portion of said elongated shank is pivoted within said upper elongated post slot down around the upper end portion of said shank and the lowest point on said bottom edge of said lower wedging ear is moved to a position just within said lower elongated slot in said post wall, the shape, dimensions and location on said elongated shank of said lower wedging ear being such that the lowest point on said bottom edge of said lower wedging ear continues to fall above the bottom edge of said lower elongated slot in said post wall as said lower end portion of the wedge connector is pivoted farther beyond the position in which said lower ear lies just within said lower elongated slot in said post wall, the shape and dimensions of said lower ear being such that said ear is inserted, after the wedge connector has been pivoted as just described, entirely through said lower post slot and said cross heam support plate, said inner edge of each of said upper and lower wedging ears having a first inclined surface that is inclined away from said shank in the upward direction towards the free end of the ear, with the bottom portion of said inner edge being spaced from said inner edge of said shank a distance less than the combined thickness of said cross beam support plate and the wall of said post, to provide a wedging surface to confine (i) the portion of said support plate that lies immediately above said elongated slot in said plate, and (ii) the portion of said support plate that lies immediately above said bottom edge of the plate, respectively, when said support plate slot is aligned with said upper post slot, said lower wedging ear is inserted as aforesaid in the elongated slots thus aligned, and the support plate is moved downward, whereby portions of said support plate above the confined portions just mentioned are urged against the outer surface of the wall of said upright post, and said inner edge of said shank is urged against the inner surface of the wall of said upright post, thereby connecting said support plate and its associated cross beam securely to the post.

2. The wedge connector of claim 1 in which said elongated shank also extends downward a distance below said lower post slot.

3. The wedge connector of claim 1 in which said upper edge of said elongated shank is rounded so as to facilitate pivoting of the elongated shank, after said lower wedging ear has been inserted in the upper one of said pair of elongated slots in the post wall, down around to a position where said lower ear can pass through the lower one of said pair of elongated slots in the post.

4. The wedge connector of claim 1 in which the bottom edges of said upper wedging ear and said lower wedging ear both slant slightly upward in the direction away from said elongated shank towards said outer side edges of said two ears.

5. The wedge connector of claim 1 in which the bottom portion of said upper wedging ear extends below the laterally extending ear-supporting member carrying said upper ear, to form a downwardly opening notch having a rectangular cross section, and to provide a protuberance to abut the outer surface of the wall of the upright post.

6. The wedge connector of claim 1 in which both the bottom portion of said lower wedging ear and the bottom portion of said elongated shank extend below the laterally extending ear-supporting member carrying said lower ear, to form a downwardly opening notch having a rectangular cross section, and to provide a protuberance abutting the outer surface of the wall of the upright post.

7. The wedge connector of claim 1 in which the distance between the highest point on said upper edge of said upper wedging ear and the lowest point on said bottom edge of said upper ear, measured parallel to said inner edge of said elongated shank, is larger than said first predetermined length of said upper elongated post slot.

8. The wedge connector of claim 1 in which a second inclined surface on the uppermost portion of the inner edge of each of said wedging ears is inclined at a greater angle than the wedging surface heretofore described, to narrow the free end of the ear and to provide a larger space to receive the respective portions of the cross beam support plate as the beam is lowered into place against the upright post.

9. A wedge connector in conbination with a knock-down storage rack that includes a hollow, upright, post having an inside, an outside and at least one pair of vertically aligned, vertically oriented, spaced elongated slots in the wall of said post, the upper slot of said pair having a first predetermined length, the lower slot having a second predetermined length, the two slots of said pair being spaced apart vertically a third predetermined distance, said rack further including a horizontal cross beam that terminates in a support plate matingly related to the exterior surface of said post, said support plate defining a vertically oriented elongated slot of substantially the same shape and dimensions as said upper elongated slot in said post wall, the bottom edge of said vertical elongated slot in said cross beam support plate being spaced above the bottom edge of the support plate a distance equal to said third predetermined distance, which wedge connector comprises:

(a) a flat, elongated shank spanning the lower one of said two post slots, the portion of the post wall lying between said two slots, and a portion of said upper slot, and extending a distance below the lower one of said two slots, the median plane of said shank being perpendicular to the respective planes tangent to the surfaces of the wall of said hollow post and of said mating support plate in the area adjacent said elongated slots in said post and said support plate, said elongated shank having a bottom edge, a straight inner edge, an upper edge and an outer edge, the inner edge of said shank abutting the inner surface of said post wall, and the outer edge of said shank being remote from said post wall, said upper edge of said elongated shank being rounded so as to facilitate pivoting of the elongated shank, after said lower wedging ear has been inserted in the upper one of said pair of elongated slots in the post wall, down around to a position where the lower portion of said shank is adjacent the lower one of said pair of elongated slots in the post;

(b) two ear-supporting members extending laterally from said straight inner edge of said elongated shank, one for each slot of said pair of post slots, said ear-supporting members being disposed one above the other, the distance between the bottom edge of the upper one of said laterally extending supporting members and the bottom edge of the lower one of said supporting members being substantially equal to said second predetermined length plus said third predetermined distance; and (c) a wedging ear supported by each of said laterally extending members, said two ears being disposed one above the other, with a free end of each of said ears being directed upward, each of said ears having a bottom edge, an outer side edge, an upper edge located at the free end of the ear, and an inner edge adjacent the upper portion of said ear, the shape and dimensions of said wedging ear carried by said lower supporting member being such that the lower end portion of said wedge connector, with said wedging ears pointed downward and the longitudinal axis of said elongated shank generally perpendicular to the upper one of said two elongated slots, can be inserted from outside the post into said upper post slot, the shape and dimensions of said wedging ear carried by said upper supporting member being such that the upper end portion of said wedge connector can not pass through said upper post slot when said lower end portion of said wedge connector is being inserted in said upper post slot as just described, the shape and dimensions of the upper portion of said elongated shank and the shape, dimensions, and location on said shank of said two wedging ears being such that, after said lower wedging ear has been inserted in said upper elongated post slot while said cross beam support plate is matingly engaged with said post wall and said upper post slot and said support plate slot are aligned with each other, the lower end portion of said elongated shank is pivoted within said upper elongated post slot down around the upper end portion of said shank, thereby moving the lowest point on said bottom edge of said lower wedging ear to a position just within said lower elongated slot in said post wall, the shape, dimensions, and location on said elongated shank of said lower wedging ear being such that the lowest point on said bottom edge of said lower wedging ear continues to fall above the bottom edge of said lower elongated slot in said post wall when said lower end portion of the wedge connector is pivoted farther beyond the position in which said lower ear lies just within said lower elongated slot in said post wall, the shape and dimensions of said lower wedging ear being such that said ear passes, after the wedge connector has been pivoted as just described, entirely through said lower post slot, the distance between the highest point on said upper edge of said upper wedging ear and the lowest point on said bottom edge of said upper ear, measured parallel to said inner edge of said elongated shank, being larger than said first predetermined length of said upper elongated post slot, the bottom edges of said upper wedging ear and said lower wedging ear both slanting slightly upward in the direction away from said elongated shank towards said outer side edges of said two ears, the bottom portion of both said upper and lower wedging ears extending below their respective laterally extending ear-supporting members, and the bottom edge of said elongated shank extending below the bottom edge of the ear-supporting member for said lower ear, to form two downwardly opening notches having rectangular cross sections, and to provide two protuberances abutting the outer surface of the wall of the upright post, said inner edge of each of said upper and lower wedging ears having a first inclined surface that is inclined away from said shank in the upward direction towards the free end of the ear, with the bottom portion of said inner edge being spaced from said inner edge of said shank a distance less than the combined thickness of said cross beam support plate and the wall of said post, to provide a wedging surface to confine (i) the portion of said support plate that lies immediately above said elongated slot in said plate, and (ii) the portion of said support plate that lies immediately above said bottom edge of the plate, respectively, when said support plate slot is aligned with said upper post slot, said lower wedging ear is inserted as aforesaid in the elongated slots thus aligned, and the support plate has been moved downward, a second inclined surface being provided on the uppermost portion of the inner edge of each of said wedging ears, said second surface being inclined at a greater angle than the wedging surface heretofore described, to narrow the free end of the ear and to provide a larger space to receive the respective portions of the cross beam support plate as the beam is lowered into place against the upright post, whereby portions of said support plate above the confined portions just mentioned are urged against the outer surface of the wall of said upright post whereby portions of said support plate above the confined portions just mentioned are urged against the outer surface of the wall of said upright post, and said inner edge of said shank is urged against the inner surface of the wall of said upright post, thereby connecting said support plate and its associated cross beam securely to the post.

10. The wedge connector of claim 1 in which the distance between the lowest point on said bottom edge of said lower wedging ear and the highest point on the upper edge of said lower ear, measured generally parallel to said inner edge of said elongated shank, is less than said second predetermined length of said lower elongated post slot.

11. The wedge connector of claim 1 in which the distance between the lowest point on said bottom edge of said lower wedging ear and the highest point on said upper edge of said elongated shank member is less than said first predetermined length plus said second predetermined length plus said third predetermined distance.

12. The wedge connector of claim 1 in which the shape, dimensions, and location on said elongated shank of said upper wedging ear are such that the upper end portion of said wedge connector can not pass through said upper elongated post slot during the after the aforesaid downward pivoting of the lower end portion of said elongated shank and insertion of said lower wedging ear in said lower elongated post slot.

* * * * *

UNITED STATES PATENT AND TRADEMARK OFFICE

CERTIFICATE OF CORRECTION

PATENT NO. : 4,741,445

DATED : May 3, 1988

INVENTOR(S) : Herbert H. Klein

It is certified that error appears in the above-identified patent and that said Letters Patent is hereby corrected as shown below:

Col. 1, line 6, after "to" insert -- the combination of --; line 7, "racks" should be -- rack --; line 9, after "to" delete -- the combination of --.

Col. 4, line 30, after "Fig. 3" insert -- is --.

Col. 8, line 66, after "width" insert -- , a --.

Col. 9, line 1, delete the comma after "outer"; line 11, after "directed" insert -- upward, --; line 60, correct the spelling of "beam".

Col. 10, line 63, correct the spelling of "combination."

Col. 13, delete lines 3, 4 and 5; line 6, begin a new paragraph with "whereby."

Col. 14, line 13, after "during" delete the word "the" and insert the word -- and --.

Signed and Sealed this

Eleventh Day of October, 1988

*Attest:*

DONALD J. QUIGG

*Attesting Officer*

*Commissioner of Patents and Trademarks*